United States Patent [19]

Vogels et al.

[11] Patent Number: 4,783,611

[45] Date of Patent: Nov. 8, 1988

[54] HIGH-PRESSURE GAS DISCHARGE LAMP WITH ELECTRODES HAVING DOUBLE LAYER COIL

[75] Inventors: Anthonius B. P. Vogels; Peter L. F. J. Marks, both of Eindhoven, Netherlands

[73] Assignee: U.S. Philips Corp., New York, N.Y.

[21] Appl. No.: 127,860

[22] Filed: Dec. 2, 1987

[30] Foreign Application Priority Data

Dec. 12, 1986 [NL] Netherlands ..... 8603165

[51] Int. Cl.[4] ..... H01J 61/073; H01J 61/30

[52] U.S. Cl. ..... 313/25; 313/628; 313/631

[58] Field of Search ..... 313/628, 344, 631, 25

[56] References Cited

U.S. PATENT DOCUMENTS 3,170,081 2/1965 Rokosz ..... 313/631

FOREIGN PATENT DOCUMENTS 168343 12/1981 Japan ..... 313/628

316134 10/1971 U.S.S.R. ..... 313/631

2107513 4/1983 United Kingdom ..... 313/631

*Primary Examiner*—Palmer C. DeMeo

*Attorney, Agent, or Firm*—Brian J. Wieghaus

[57] ABSTRACT

The high-pressure gas discharge lamp according to the invention has at least one electrode comprising an electrode rod and a helical winding near its tip projecting into the lamp vessel, both mainly of tungsten. The winding has a first layer of turns directly around the rod with locally a turn of high pitch P. The winding has around the first layer another layer of turns which is wound in opposite direction and has a turn of high pitch gripping around the turn of high pitch of the first layer forming therewith contact areas located diametrically opposite to each other. Between the contact areas high pitched turn of the outer layer engages the rod with a clamping fit. An additional turn of the second layer wound in the same direction as the first layer is disposed over the high pitched turns of the second layer in the region where the high pitched turn of the second layer engages the electrode rod. The winding has the same diameter over its entire length and is fixed firmly to the electrode rod.

12 Claims, 2 Drawing Sheets

HIGH-PRESSURE GAS DISCHARGE LAMP WITH ELECTRODES HAVING DOUBLE LAYER COIL

BACKGROUND OF THE INVENTION

The invention relates to a high-pressure gas discharge lamp comprising a translucent lamp vessel, which is sealed in a vacuum-tight manner and is filled with an ionizable gas. The lamp has electrodes projecting into the lamp vessel connected to current supply conductors which extend to the exterior through the wall of the lamp vessel. At least one electrode comprises a rod of mainly tungsten, which has near its tip projecting inside the lamp vessel a helical winding of wire of mainly tungsten. A first layer of turns is arranged to surround the rod and an outer layer of turns is arranged to surround the first layer. The first layer of turns locally having a turn of high pitch P being at least equal to the wire diameter of the first layer of turns plus the wire diameter of the outer layer of turns. The winding is fixed on the rod. Such a lamp is known from U.S. Pat. No. 3,170,081.

The purpose of the winding around the electrode rod is to obtain a satisfactory temperature variation over the electrode or to hold electron-emitting material.

It is necessary to fix the winding on the rod, for example by deforming a turn in the hot state so that it clamps around the rod, or by welding the winding locally to the rod.

In the lamp according to the aforementioned U.S. Pat. No. 3,170,081, the first layer of turns is a body, which is slipped with a certain amount of clearance around the electrode rod and is fixed on it by deforming the layer in the hot state, while the outer layer of turns is a separate body slipped around the first layer. In order to fix the second layer of turns, the first layer of turns has a projecting wire portion at its end remote from the tip of the electrode rod, while the outer layer of turns has at the corresponding end a wire portion bent towards the rod. This electrode construction renders it difficult to manufacture the electrodes and therefore the lamp.

The non-prepublished European patent application No. 86201239.0 corresponding to U.S. application Ser. No. 884,699, of the Applicant discloses a lamp of the kind described in the opening paragraph, in which the outer layer of turns of the winding of the electrode grips at least twice around a turn of high pitch of the first layer, while forming an equal number of contact areas and engaging with clamping fit the electrode rod at least substantially diametrically opposite to those contact areas. The turn(s) of the outer layer of turns gripping around a turn of high pitch of the first layer has (have) a pitch corresponding to the pitch of the remaining turns of the outer layer of turns, i.e. equal to the wire diameter.

SUMMARY OF THE INVENTION

The invention has for its object to provide a high-pressure gas discharge lamp of the kind mentioned in the opening paragraph, of which at least one of the electrodes has an overwind of simple construction that can readily be manufactured and in which the winding is nevertheless firmly fixed on the electrode rod.

According to the invention, this object is achieved in a high-pressure gas discharge lamp of the kind mentioned in the opening paragraph in that the outer layer of turns is wound in a direction opposite to that of the first layer and has at least one turn having a pitch corresponding to the pitch P and gripping around a turn having a pitch P of the first layer of turns, while forming therewith contact areas located substantially diametrically to each other, and engaging between each pair of contact areas the electrode rod with clamping fit.

In contrast with the electrodes according to the aforementioned U.S. Pat. No. 3,170,081, in which the electrodes are assembled from separately manufactured bodies, the at least one electrode of the lamp according to the invention uses the electrode rod itself as a winding mandrel. During the manufacture of the electrode, an assembling step is thus dispensed with, which is advantageous especially if the electrode, the rod and the winding are small and consequently vulnerable. Furthermore, a separate step for fixing the winding is dispensed with. Nevertheless the winding of the electrode is firmly fixed.

The fixing of the winding on the electrode rod can be explained as follows. When a wire is wound around a mandrel (a rod), the turns of said wire have a tendency to assume a larger diameter. In the case of a round mandrel, this larger turn diameter is obtained in that the wire can slide tangentially along the mandrel due to elastic relaxation.

This also applies to a second layer of turns, which is disposed on a first layer of turns, if said second layer is wound in the same direction as the first layer. Also in this case, the "mandrel", i.e. the rod onto which the first layer was wound, together with said first layer is round. If said second layer of turns, however, is wound in the opposite direction, the "mandrel" is not purely round because the turns of said second layer must each time jump over the turns of the first layer. The "out-of-roundness" of the mandrel is very small. The deviation from the round form has the size of only a fraction of the wire diameter, while the "mandrel" diameter is comparatively large, i.e. equal to the diameter of the rod onto which there is wound plus twice the wire diameter. Due to said small "out-of-roundness", the wire can slide tangentially also in this case, as a result of which the turns assume a larger diameter and the layers become loosely arranged.

If a wire is wound around a rod with locally a high pitch P, the assembly of rod and wire is very unround locally and has an oval cross-section. Turns of an outer layer of turns, when wrapped around the rod and the the first layer of turns, substantially cannot slide tangentially and thus cannot be removed. This is the case when the outer layer of turns is wound in the same direction as the first layer and when it is wound in the opposite direction as the first layer. The winding is fixed on the rod when at least a portion of the outer layer of turns cannot be moved because said portion is situated between two areas at which the outer layer of turns is held so that a tangential displacement is not possible. If the first layer of turns is integral with the outer layer of turns and the outer layer of turns grips, at least once around a turn of high pitch of the first layer of turns and around the mandrel, then a portion of the outer layer of turns is situated between two areas at which the outer layer of turns is held. The first area is where the first layer of turns passes into the other layer of turns. The second area is where the outer layer of turns grips around a turn of high pitch P in the first layer.

The fixing of the winding on the electrode rod of the lamp according to the aforementioned non-prepublished European patent application No. 86201239.0 corresponding to U.S. application Ser. No. 884,699, is based on the facts set out in the preceding paragraph.

In the at least one electrode of the lamp according to the invention, a turn of high pitch of the outer layer of turns forms contact areas arranged diametrically to each other with a turn of high pitch P in the first layer of turns. This turn engages the electrode rod with clamping fit between each pair of these contact areas. The "mandrel" onto which this turn of high pitch is wound is therefore very unround. Tangential displacement of this turn is therefore prevented in a very reliable manner.

In a favourable embodiment, the first layer of turns and the outer layer of turns are integral with each other and near the tip of the electrode rod a turn of the first layer of turns passes into a turn of the outer layer of turns.

In a preferred embodiment, the said turn of high pitch P in the first layer of turns is present at the end of the winding remote from the tip of the electrode rod.

The use of such a winding, whose layers are integral with each other further simplifies the manufacture of the electrode. In the preferred embodiment, the additional advantage is obtained that the turns are in intimate contact both with each other and with the electrode rod. As a result, a satisfactory heat transfer from the rod to its winding is obtained.

In a variation, the outer layer of turns is integral with an additional turn, which is disposed on the turn of high pitch in the outer layer of turns, this additional turn extending mainly parallel to the turn of high pitch P of the first layer of turns and being in contact with the electrode rod. It has been found that in this variation the winding is very firmly fixed. This becomes manifest, for example, when the winding is made of a comparatively thick wire.

In order to explain the term "pitch", it should be noted that, if turns are made having a pitch equal to the wire diameter, adjacent turns engage each other laterally.

The electrode and hence the high-pressure gas discharge lamp can be manufactured even more readily if the winding of the electrode rod has a wire end with a rupture surface. Such a rupture surface is obtained in that, after the process of helically winding has been accomplished, the remaining wire portion not wound helically is severed from the winding by tensile rupture. The wire then breaks at the area at which it loses its contact with the electrode.

Rupture surfaces have a characteristic appearance, as a result of which they are easily recognized as such by those skilled in the art. They have a rough surface, which is dull due to the roughness. They further are devoid of tracks, such as grooves or a burr, which are left in or at a separation surface by tools, for example cutting, pinching, shearing or grinding tools.

When the winding is wound around the electrode rod, the beginning of the wire is held in a clamp. When the winding is finished, excess wire at the beginning can also be severed by tensile rupture.

The lamp according to the invention may be a high-pressure sodium lamp provided with a ceramic vessel of, for example, (polycrystalline) aluminium oxide or (monocrystalline) sapphire, or a high-pressure mercury discharge lamp, which may contain metal halides and has a ceramic or quartz glass lamp vessel.

BRIEF DESCRIPTION OF THE DRAWINGS

Embodiments of the lamp according to the invention are shown in the drawing. In the drawing.

DESCRIPTION OF THE PREFERRED EMBODIMENT

Figure 1:
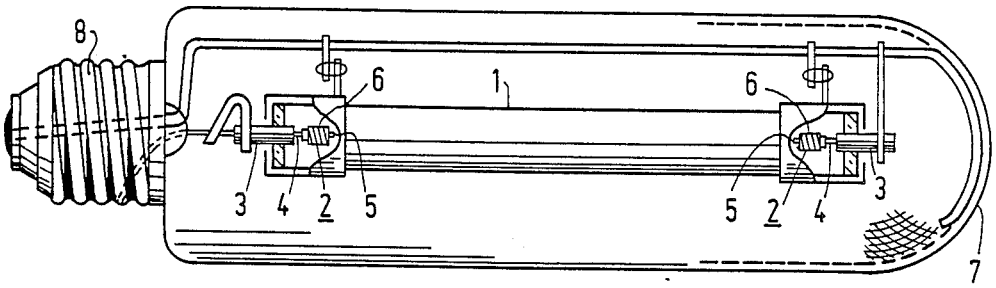
FIG. 1 shows a high-pressure sodium discharge lamp in side elevation broken away with diagrammatically indicated electrodes.

The high-pressure sodium discharge lamp shown in FIG. 1 has a translucent lamp vessel 1 of mainly aluminium oxide, which is sealed in a vacuum-tight manner and has an ionizable filling of sodium, mercury and xenon. Electrodes 2 project into the lamp vessel 1, which are connected to current supply conductors 3, which extend to the exterior through the wall of the lamp vessel. The electrodes 2 each have an electrode rod 4 of mainly tungsten, which near its tip 5 projecting inside the lamp vessel 1 has a helical winding 6 of wire of mainly tungsten. A first layer of turns having locally a turn of high pitch P at least equal to the wire diameter of the first layer of turns plus the wire diameter of another layer of turns of the helical winding 6 is arranged to surround the electrode rod 4, while another layer of turns is arranged to surround the first layer of turns. The winding 6 is fixed on the electrode rod 4. The electrodes 2 are described more fully with reference to FIGS. 3 to 5, while alternative electrodes are described with reference to FIGS. 6 to 8. The lamp vessel 1 is arranged in an outer envelope 7, which is sealed in a vacuum-tight manner and has a lamp cap 8.

Figure 2:
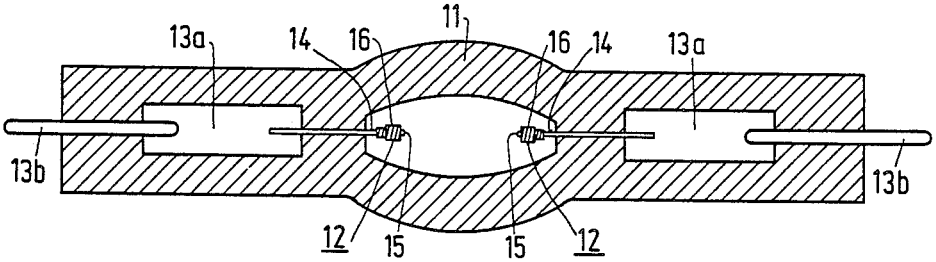
FIG. 2 shows a high-pressure mercury discharge lamp in longitudinal sectional view with diagrammatically indicated electrodes.

The high-pressure mercury discharge lamp of FIG. 2 has a quartz glass lamp vessel 11, which is sealed in a vacuum-tight manner and has an ionizable filling of argon, mercury, sodium iodide, scandium iodide and thallium iodide. Electrodes 12 connected to current supply conductors 13*a*, 13*b* projecting from the lamp vessel 11 to the exterior project into the lamp vessel 11. They have an electrode rod 14 of mainly tungsten, which has at its tip 15 projecting inside the lamp vessel 11 a helical winding 16 of wire of mainly tungsten. A first layer of turns locally having a turn of high pitch P at least equal to the wire diameter of the first layer of turns plus the wire diameter of another layer of turns of the helical winding 16 is arranged to surround the electrode rod 14, while another layer of turns is arranged to surround the first layer of turns. The windig 16 is fixed on the electrode rod 14. The electrodes 12 are described with reference to FIGS. 3 to 5, while alternative electrodes are described with reference to FIGS. 6 to 8.

Figure 3:
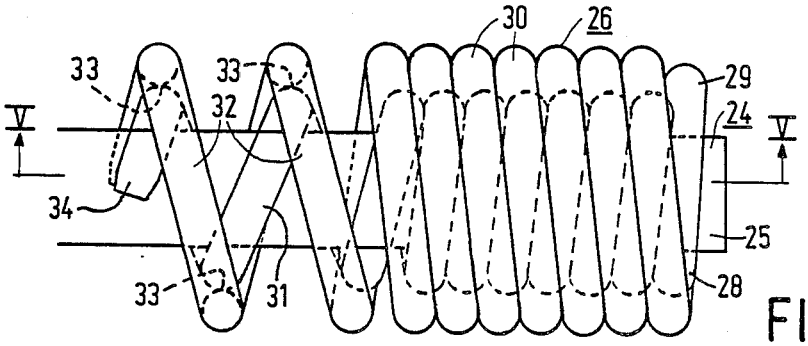
FIG. 3 shows an electrode in side elevation.
Figure 4:
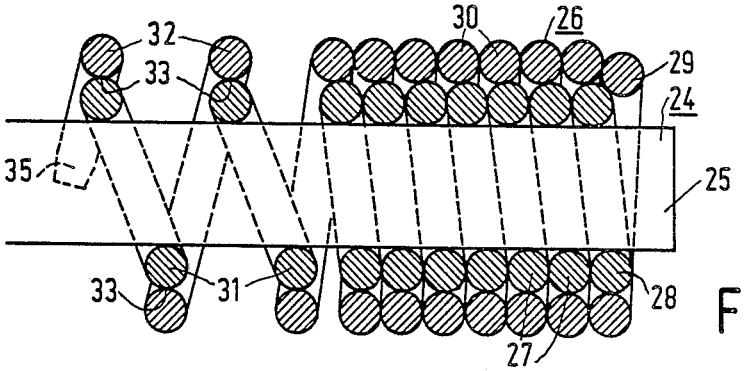
FIG. 4 shows the electrode of FIG. 3 in longitudinal sectional view.
Figure 5:
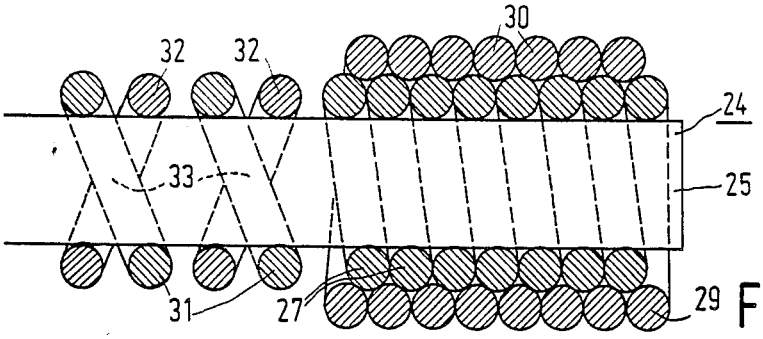
FIG. 5 shows the electrode of FIG. 3 in sectional view taken on V—V.

In FIGS. 3, 4 and 5, the electrode rod 24 of mainly tungsten has at its tip 25 projecting inside the lamp vessel a helical winding 26 of wire of mainly tungsten. The electrode rod 24 is directly surrounded by a first layer of turns 27, of which the last turn 28 passes near the tip 25 of the electrode rod 24 into the first turn 29 of an outer layer of turns 30, which is arranged to surround the first layer of turns 27. As a result, the first layer of turns 27 is integral with the outer layer of turns 30.

The first layer of turns 27 locally has a turn 31 of high pitch P, which pitch P is at least equal to the wire diameter of the first layer of turns 27 plus the wire diameter of the outer layer of turns 30. In the embodiment shown, the pitch P is therefore at least twice the wire diameter, as the first layer and the outer layer are made of the same wire.

The winding 26 is fixed on the electrode 24 in that the outer layer of turns 30 is wound in a direction opposite to that of the first layer 27 and has at least one turn 32 having a pitch corresponding to the pitch P, gripping round a turn 31 of pitch P of the first layer of turns 27, while forming therewith contact areas 33 located substantially diametrically to each other, and engaging the electrode rod 25 with clamping fit between each pair of contact areas 33. The turn 31 of high pitch P in the first layer of turns 27 is present near that end of the winding 26 which is remote from the tip 25 of the electrode rod.

In FIG. 4, the contact areas 33 are clearly visible. Per whole turn 32 two such contact areas 33 are present due to the fact that the pitch of the turn 32 in the Figure is identical to the pitch P of the turn 31. If the pitch of the turn 32 should deviate from P, the number of contact areas per whole turn 32 would be a fraction larger or smaller.

In FIG. 5, which is a sectional view which is drawn through the axis of the rod 24, rotated through 90° with respect to FIG. 4, it is visible that the turn 32 engages with clamping fit the electrode rod 25 between each pair of contact areas 33 (cf. also FIGS. 3 and 4). The beginning 34 (FIG. 3) of the first layer of turns 27 and the end 35 (FIG. 4) of the outer layer of turns 30 were obtained by severing excess wire by tensile rupture. The turn 32 is very unround due on the one hand to its two contact areas 33 far remote from the axis of the rod 24 and on the other hand to the engagement with the rod 25 between these areas. The turn 32 can thus not be relieved and exerts a great frictional force on the rod 24, which counteracts displacement of the winding 26. Although the winding 26 is made of one piece of wire, the turns of the outer layer 30 are for the sake of clarity differently hatched in FIGS. 4 and 5.

Figure 6:
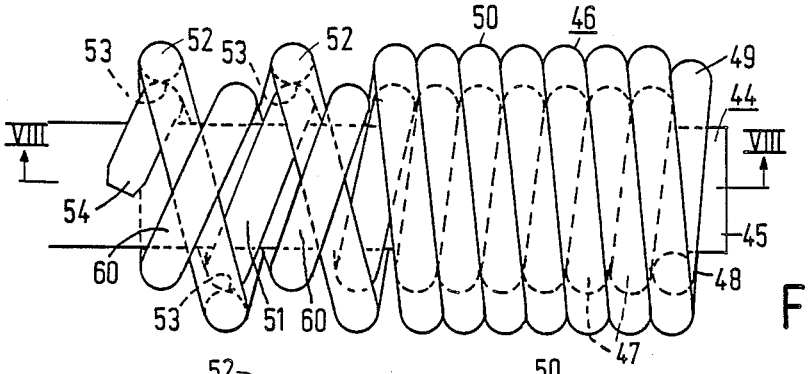
FIG. 6 shows another embodiment of the electrode in side elevation.
Figure 7:
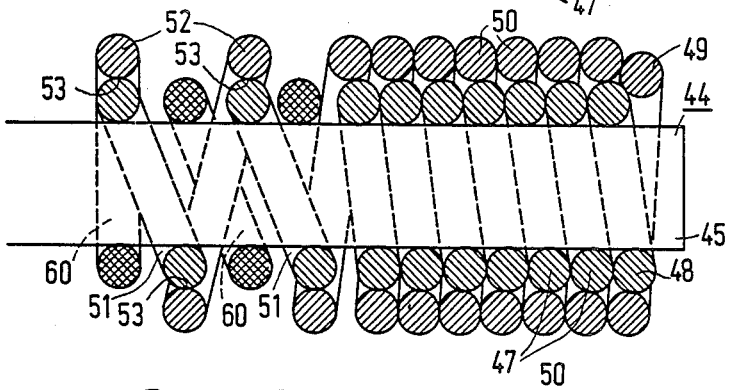
FIG. 7 shows the electrode of FIG. 6 in longitudinal sectional view.
Figure 8:
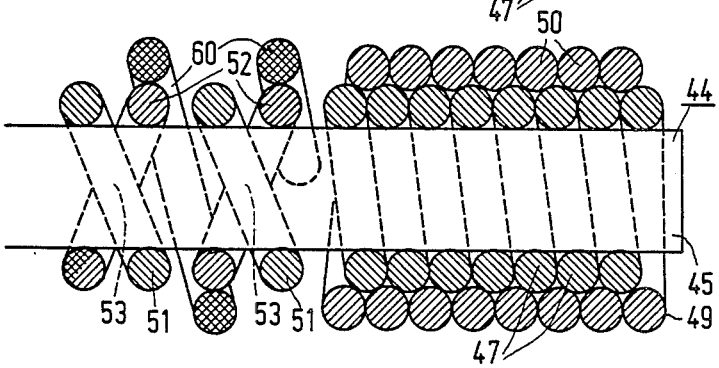
FIG. 8 shows the electrode of FIG. 6 in sectional view taken on VIII—VIII.

In FIGS. 6, 7 and 8, corresponding parts are designated by a reference numeral which is 20 higher than in the preceding Figures. The outer layer of turns 50 is integral with an additional turn 60 (nevertheless hatched differently for the sake of clarity), which is disposed over the turn 52 of high pitch in the outer layer of turns 50 (FIG. 8) and extends mainly parallel to the turn 51 of high pitch P of the first layer of turns 47 and is in contact with the electrode rod 44 (FIGS. 6, 7). The turn 60 is unround to the same extent as the turn 52 and thus provides an additional fixing of the winding 46. It is remarkable that the winding 46 in the drawing has the same transverse dimension near the tip 45 as at its other end in spite of the triple character of the winding 46 at the latter end.

A winding of tungsten wire having a diameter of 70 μm was disposed on a tungsten rod having a diameter of 200 μm. The winding consisted of two layers which passed into each other at one end of the winding. The winding had a length of approximately 1 mm. On the first layer of turns a welding connection with the rod was formed. It was found that the winding could be pushed off the rod by a force of 3N.

With a rod and a wire of the same thicknesses, electrodes according to FIGS. 6–8 were manufactured. The winding had a length of approximately 1 mm. A force of 12N was found to be required to push the winding off the rod. The largest diameter of the wound rod was approximately 480 μm, from which an intimate contact of the turns with each other and of these turns and the rod becomes apparent. The largest diameter of a wound rod with windings fixed by welding was considerably larger. The turns were looser with respect to each other and to the rod for welded windings.

What is claimed is:

1. A high pressure discharge lamp, comprising:
(a) an outer envelope;
(b) a translucent discharge vessel containing an ionizable gas;
(c) current-supply conductors; and
(d) electrodes connected to said current-supply conductors which project into said discharge vessel so that during lamp operation an arc is established between said electrodes, each electrode comprising an electrode rod defining a tip end of said electrode and an electrode coil having a first layer of turns with a first winding sense surrounding the electrode rod and a second layer of turns surrounding said first layer with a winding sense opposite the first winding sense, said first layer comprising a first length of wire having a first nominal diameter and said second layer comprising a second length of wire having a second nominal diameter,
said first layer of turns comprising a first high-pitched turn having a pitch P at least equal to said first nominal diameter plus said second nominal diameter and said second layer of turns having a second high-pitched turn with a pitch corresponding to pitch P, said second high-pitched turn crossing said first high-pitched turn at diametrically opposite contact areas and gripping said first high-pitched turn to secure said second layer to said first layer, and said second high-pitched turn engaging said electrode rod with a clamping fit between said diametrically opposite contact areas to secure said first and second layers to said electrode rod.

2. A high-pressure discharge lamp as claimed in claim 7, wherein the first and second layer of turns comprise a single length of wire and a turn of the first layer of turns passes near said tip end of the electrode into a turn on the second layer of turns.

3. A high-pressure discharge lamp as claimed in claim 2, wherein said turn of high pitch P in the first layer of turns is present at the end of the winding remote from said tip end of the electrode.

4. A discharge lamp as claimed in claim 3, wherein said second layer of turns comprises an additional turn which extends parallel to said high-pitched turn of the first layer, crosses over said second high-pitched turn of the second layer in the region where said second high-pitched turn engages said electrode rod, and contacts said electrode rod for fixing said second layer of turns to said first layer of turns and said electrode rod, said additional turn having a dimension transverse to said electrode rod which is less than or equal to the transverse dimension of the second layer of turns near said tip end.

5. A discharge lamp as claimed in claim 4, wherein said length of wire has end portions at the ends of said first and second layers remote from said tip end, and said end portions are rupture surfaces formed by tensile rupture.

6. A discharge lamp as claimed in claim 1, wherein said second layer of turns comprises an additional turn which extends parallel to said high-pitched turn of the first layer, crosses over said second high-pitched turn of the second layer in the region where said second high-pitched turn engages said electrode rod, and contacts said electrode rod for fixing said second layer of turns to said first layer of turns and said electrode rod, said additional turn having a dimension transverse to said electrode rod which is less than or equal to the transverse dimension of the second layer of turns near said tip end.

7. A discharge lamp discharge electrode, comprising:

an electrode rod defining a tip end of said electrode and an electrode coil having a first layer of turns with a first winding sense surrounding the electrode rod and a second layer of turns surrounding said first layer with a winding sense opposite the first winding sense, said first layer comprising a first length of wire having a first nominal diameter and said second layer comprising a second length of wire having a second nominal diameter, said first layer of turns comprising a first high-pitched turn having a pitch P at least equal to said first nominal diameter plus said second nominal diameter and said second layer of turns having a second high-pitched turn with a pitch corresponding to pitch P, said second high-pitched turn crossing said first high-pitched turn at diametrically opposite contact areas and gripping said first high-pitched turn to secure said second layer to said first layer, and said second high-pitched turn engaging said electrode rod with a clamping fit between said diametrically opposite contact areas to secure said first and second layers to said electrode rod.

8. A discharge lamp discharge electrode as claimed in claim 7, wherein the first and second layer of turns comprise a single length of wire and a turn of the first layer of turns passes into a turn on the second layer of turns said tip end of the electrode.

9. A discharge lamp discharge electrode as claimed in claim 8, wherein said turn of high pitch P in the first layer of turns is present at the end of the winding remote from said tip end of the electrode.

10. A discharge lamp discharge electrode as claimed in claim 9, wherein said second layer of turns comprises an additional turn which extends parallel to said first high-pitched turn of the first layer, crosses over said second high-pitched turn of the second layer in the region where said second high-pitched turn engages said electrode rod, and contacts said electrode rod for fixing said second layer of turns to said first layer of turns and said electrode rod, said additional turn having a dimension transverse to said electrode rod which is less than or equal to the transverse dimension of the second layer of turns near said tip end.

11. A discharge lamp electrode as claimed in claim 10, wherein said length of wire has end portions at the ends of said first and second layers remote from said tip end, and said end portions are rupture surfaces formed by tensile rupture.

12. A discharge lamp discharge electrode as claimed in claim 7, wherein said second layer of turns comprises an additional turn which extends parallel to said first high-pitched turn of the first layer, crosses over said second high-pitched turn of the second layer in the region where said second high-pitched turn engages said electrode rod, and contacts said electrode rod for fixing said second layer of turns to said first layer of turns and said electrode rod, said additional turn having a dimension transverse to said electrode rod which is less than or equal to the transverse dimension of the second layer of turns near said tip end.

* * * * *